US010633838B2

(12) United States Patent
Durou et al.

(10) Patent No.: US 10,633,838 B2
(45) Date of Patent: Apr. 28, 2020

(54) DEVICE FOR RECOVERING THERMAL ENERGY FROM A FLOW OF WASTE WATER

(71) Applicant: ENERGY HARVESTING TECH, Ramonville St. Agne (FR)

(72) Inventors: Hugo Durou, Toulouse (FR); Thomas Ricou, Toulouse (FR)

(73) Assignee: Energy Harvesting Tech, Ramonville St. Agne (FR)

( * ) Notice: Subject to any disclaimer, the term of this patent is extended or adjusted under 35 U.S.C. 154(b) by 776 days.

(21) Appl. No.: 14/773,736

(22) PCT Filed: Mar. 5, 2013

(86) PCT No.: PCT/EP2013/054448
§ 371 (c)(1),
(2) Date: Nov. 20, 2015

(87) PCT Pub. No.: WO2013/131930
PCT Pub. Date: Sep. 12, 2013

(65) Prior Publication Data
US 2016/0115677 A1 Apr. 28, 2016

(51) Int. Cl.
*E03C 1/00* (2006.01)
*E03C 1/122* (2006.01)

(52) U.S. Cl.
CPC ..... *E03C 1/00* (2013.01); *E03C 1/1222* (2013.01); *E03C 2001/005* (2013.01)

(58) Field of Classification Search
CPC ..... E03C 1/00; E03C 1/1222; E03C 2001/005
(Continued)

(56) References Cited

U.S. PATENT DOCUMENTS 5,131,423 A * 7/1992 Shaw ..... E03B 7/04 137/1
2008/0105839 A1* 5/2008 Jennings ..... F16K 7/07 251/61.1

(Continued)

FOREIGN PATENT DOCUMENTS

AT 509 213 A4 7/2011
CA 1 148 934 A1 6/1983

(Continued)

OTHER PUBLICATIONS

FR 2939186 A1 Translation.*

*Primary Examiner* — Erin Deery
*Assistant Examiner* — William R Klotz
(74) *Attorney, Agent, or Firm* — Defillo & Associates, Inc.; Evelyn A Defillo

(57) ABSTRACT

Device for recovering thermal energy from a flow of wastewater from a basin includes a plate heat exchanger traversed by two separate fluid flows and a bypass conduit providing a hydraulic connection. A first inlet of the heat exchanger is placed in a fluid communication with the wastewater outflow opening of the basin to provide a first flow passing through the heat exchanger between the first inlet and a first outlet of the heat exchanger connected to the sewer. A second inlet of the heat exchanger is placed in a fluid communication with a clean water conduit under a water supply network pressure to provide a second flow passing through the heat exchanger without mixing with the first flow, and between the second inlet and a second outlet of the heat exchanger. The bypass conduit provides a bypass between the first inlet of the heat exchanger and the sewer.

7 Claims, 5 Drawing Sheets

(58) Field of Classification Search
USPC ..... 137/1, 340; 4/598
See application file for complete search history.

(56) References Cited

U.S. PATENT DOCUMENTS

| | | | | |
|---|---|---|---|---|
| 2011/0146798 | A1* | 6/2011 | Hutton | F16K 11/20 137/1 |
| 2016/0178071 | A1* | 6/2016 | Javeheri | F16K 7/075 137/1 |

FOREIGN PATENT DOCUMENTS

| | | | | |
|---|---|---|---|---|
| DE | 29 08 679 | A1 | 9/1980 | |
| DE | 296 15 555 | U1 | 10/1996 | |
| FR | 2 381 257 | A1 | 9/1978 | |
| FR | 2 939 186 | A1 | 6/2010 | |
| FR | 2939186 | A1 * | 6/2010 | F28F 19/01 |
| FR | 2 970 071 | A1 | 7/2012 | |
| GB | 2 069 126 | A | 8/1981 | |
| WO | 2011/138467 | A1 | 11/2011 | |

* cited by examiner

5A

5B

5C

DEVICE FOR RECOVERING THERMAL ENERGY FROM A FLOW OF WASTE WATER

RELATED APPLICATIONS

This application is a § 371 application from PCT/EP2013/054448 filed Mar. 5, 2013, which is herein incorporated by reference in its entirety.

FIELD OF THE INVENTION

The invention is about a device for recovering thermal energy from a waste water flow. The device is more specifically, but not exclusively, suited for residential or collective bathroom facilities.

BACKGROUND OF THE INVENTION

A device to recover heat from waste water coming out of a basin is known from the prior art, in particular from the document WO 2011/138467. This device according to the prior art recovers heat from waste water coming out of a basin, for example a shower basin, using a plate heat exchanger. Such a device has high thermal efficiency, however, in certain circumstances, in particular when the exchanger of this device must be installed in a confined and difficult to access place, these installation conditions do not allow an operation of the device in optimal conditions. Thus, when the exchanger is permanently installed in a false ceiling or in an interjoist, especially when, for space requirements, it is placed horizontally, said exchanger acts as a siphon, and an air bubble forms in the top of the exchanger, which air bubble reduces the useful heat exchange area and therefore the efficiency of the heat recovery device, while concentrating fouling in a small volume of the exchanger.

OBJECT AND SUMMARY OF THE INVENTION

This risk of fouling is further increased when, in order not to create a double siphon phenomenon and impede the draining of waste water from the basin, the traditional siphon of the basin plug is advantageously removed. However, the unclogging of the exchanger is a challenging task when it is remote from the basin plug and not easily accessible. The invention aims to solve the problems of the prior art and to this end relates to a device for recovering heat energy from a flow of wastewater from a basin, which device comprises:

a. a plate heat exchanger passed through by two separate fluids flow:
   - ai. a first inlet of the exchanger, placed in fluid communication with the wastewater outflow opening of the basin so as to create a first stream passing through said heat exchanger between said first inlet and a first outlet connected to the sewer;
   - aii. a second inlet of the exchanger, placed in fluid communication with a clean water conduit at water supply network pressure so as to create a second flow passing through the exchanger without mixing the first stream, between this second inlet and a second outlet said exchanger;

b. which device comprises means for connection, suitable for performing a hydraulic connection, so-called bypass, between the first inlet of the exchanger and the sewer.

Thus, in case of clogging of the heat exchanger, the latter is preferably bypassed so as to allow emptying of the basin The invention is preferably implemented according to the embodiments described below, which are considered individually or in any technically operative combination.

Advantageously, the bypass connection means comprises:

bi. A bypass valve

Thus, the bypassing of the exchanger is achievable at all times, even in the absence of clogging.

Advantageously, the bypass valve is a controlled valve and the device that is subject of the invention comprises means for controlling said valve. Thus, the control of the bypass valve is easily installed remote from the exchanger in a convenient place for the user to actuate it.

Advantageously, the device that is the subject of the invention comprises:

c. controlled connecting means to achieve a temporary hydraulic connection between the arrival of cold sanitary water at water supply network pressure and the first outlet of the exchanger so as to create a flow of clean water, so-called purge flow, going through the exchanger between the arrival of cold water and the sewer.

Thus, if dirty or clogged, said exchanger is unclogged remotely by a specific control, without further need of energy other that the pressure of the water supply network. By creating a clean water flow under pressure in the normal course of sewage flow but in reverse, the device that is the subject of the invention allows, according to this embodiment, not only to unclog the exchanger through this flow but also to use this stream to fill said exchanger and expel the air bubble trapped on top of it. These means cooperate with the bypass means, to send directly to the sewer debris expelled by this purge flow.

Advantageously, the controlled connecting means comprise:

bii a controlled valve on the hydraulic connection between the outlet of the basin and the first inlet of the exchanger.

Thus, closing this valve prevents water from the cleaning flow to go up to the basin.

Advantageously, the controlled connecting means comprise:

biii a controlled valve (142), called flow stopper valve, between the first outlet of the exchanger and the sewer.

Thus, the closure of this valve allows the injection of a cleaning flow under pressure in the exchanger, even heavily clogged, without this flow preferably flowing to the sewer.

Thus, through simple valves, the device object of the invention can perform the unclogging and filling operations described above, but also bypass the exchanger in the event of clogging thereof.

Advantageously, the controlled valves placed on the pipes conveying wastewater are pinch valves controlled by the pressure of the water supply network. Thus, the device that is the subject of the invention is implemented without any form of energy other that the pressure of the water supply network. These pinch valves further help conserve significant flow section compatible with the disposal of sewage.

Advantageously, the control of pinch valves is obtained by means of a 4-way valve connected to the water supply network. Thus, the whole device is controlled by the operation of a single control, remotely from the heat exchanger.

According to an advantageous embodiment, the device object of the invention comprises:

d. means, called purge, able to connect the domestic water supply network to the first outlet of the exchanger and able to connect the stopper valve with a shutting pressure.

Thus, a single command allows the closure of the pinch valve, the closure of the heat exchanger access to the sewer, and the creation of a purge flow in said exchanger.

According to a first variant of this embodiment, the purge means comprise:

di. a normally closed monostable valve and opened for a predetermined pressure able to connect the first outlet of the exchanger in communication with the water supply network upstream of the pinch valve and the sewer;

dii. a conduit connecting hydraulically the controller of said normally closed monostable valve to the controller of the flow stopper pinch valve and to the domestic water supply network through the use of a valve, called purge valve.

Thus, the device of the invention comprises only very few valves and actuators. This makes it more reliable, easy to install and to control.

According to a second variant of the preceding embodiment, the purge means comprise:

diii. a valve, called purge valve, and a conduit able to put in fluid communication through two conduits in parallel, the controller of the flow stopper pinch valve and the first outlet of the exchanger with the domestic water supply network;

div. means capable of creating a pressure drop in the conduit in fluid communication with the first outlet of the exchanger.

Thus the device object of the invention is further simplified, but in addition the shutting pressure of the pinch valve becomes higher as the pressure drop in the conduit in fluid communication with the first outlet of the exchanger gets important, that is to say, this shutting pressure is higher when the heat exchanger is clogged. Hence, this embodiment improves the efficiency of unclogging while simplifying installation.

Advantageously, the purge valve is a programmable valve. Thus the device object of the invention is automatically unclogged regularly.

Advantageously, device according to the invention comprises:

e. a conduit, so-called progressive return conduit, putting in fluid communication in parallel the controller of the third pinch valve and the sewer, which conduit comprises means to achieve a pressure drop in the said conduit.

Thus, the purge flow is advantageously used for the filling of the exchanger.

According to an advantageous embodiment, the means for achieving a pressure drop in the progressive return conduit include a disc having an aperture of small diameter. This embodiment is particularly simple and economical to implement.

Alternatively, the means adapted to achieve a pressure drop in the progressive return conduit include an adjustable throttle valve. This method of least economic embodiment allows a fine adjustment of the device during installation.

The invention also relates to a method for filling the device according to the invention, which process comprises a step of filling the heat exchanger and remove entrapped air in the part of the exchanger through which waste water flows, by operating the purge. Thus this filling of is carried out regularly and easily by the user, and the heat exchanger maintains its effectiveness.

BRIEF DESCRIPTION OF THE DRAWINGS

The invention is described below in its preferred embodiments, in no way limiting, and with reference to FIGS. 1 to 8, in which.

DETAILED DESCRIPTION OF THE EMBODIMENTS

Figure 1:
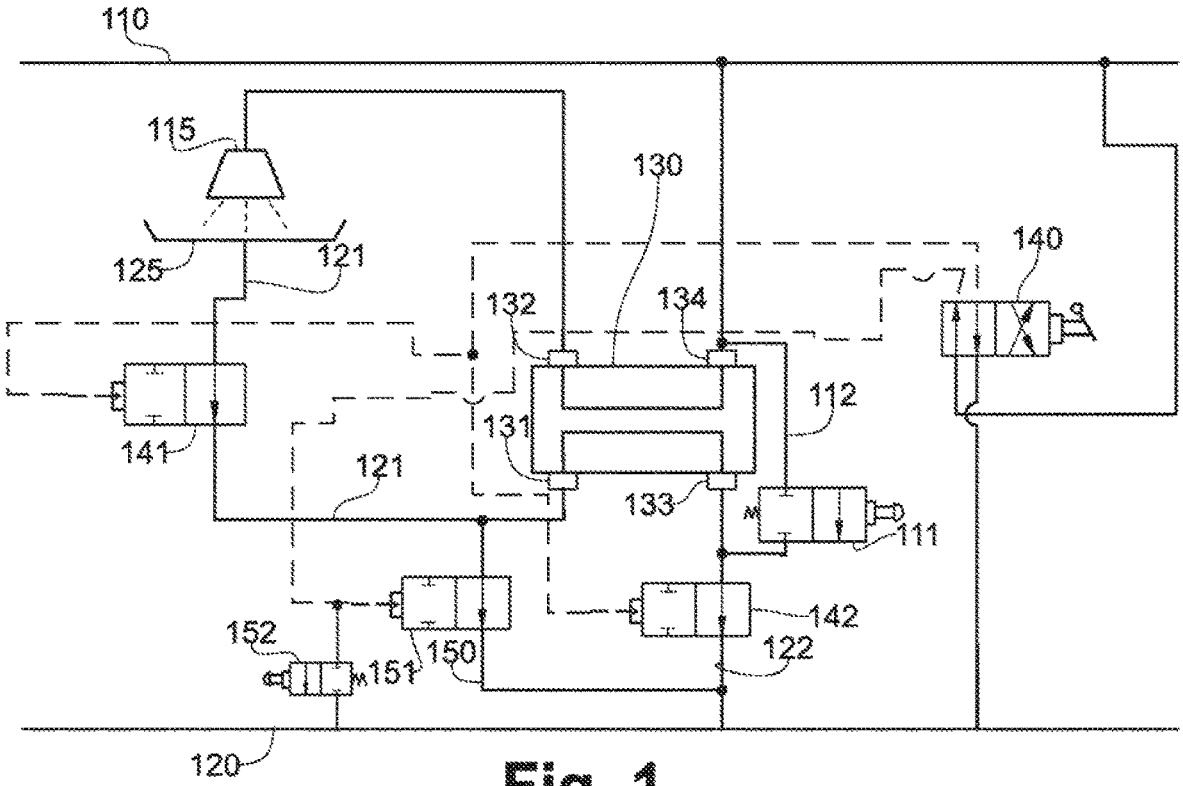
FIG. 1 shows a hydraulic diagram of an embodiment of the device of the invention.

FIG. 1, according to an exemplary embodiment, a bathroom facility embodying the device according to the invention comprises a supply (110) of domestic cold water under pressure and a conduit (120) for collecting waste water to the sewer. The domestic cold water feeds a tap (115), such as a shower mixer, where it is mixed with hot water, before discharging into a basin (125).

The basin is hydraulically connected to the sewer (120) by a conduit (121) for discharge. To get to the sewer, wastewater collected by the basin (125) passes through a plate heat exchanger (130) in which it enters through a first inlet (131) and exits through a first outlet (133). The same exchanger (130) comprises a second inlet (132) to which is connected an incoming domestic cold water and a second outlet (134) for the supply of the clean water to the tap (115). Thus, through this heat exchanger (130) the cold domestic water heading to the tap (115) is heated by the flow of wastewater.

The heat exchanger (130) comprises corrugated plates which encourage the development of a turbulent flow inside thereof, thus limiting the risks of fatty depot or debris in said exchanger (130). However, despite these characteristics, it happens that the heat exchanger becomes clogged or that plugs, in particular hair, are formed, in particular to the first inlet (131) of the exchanger (130). According to an embodiment of the device according to the invention, the exchanger (130) is placed with its inlets (131, 132) and outlets (133, 134) horizontally oriented which increases the exchange surface of the exchanger without too significantly increasing its overall height, in order to place it, for example, in the joisting of a floor.

According to the embodiment of FIG. 1, the device according to the invention comprises hydraulic fittings to blow a plug that would clog the exchanger (130). To this end, the device comprises valves (151, 141, 142, 111)

hydraulically controlled and the operation of which is triggered by a 4-way valve (140).

A first valve (151), called bypass valve, hydraulically controlled is located between the first inlet (131) of the exchanger and a conduit (150), called bypass conduit, in parallel with this first inlet to the sewer (120).

A second valve (141) is placed on the pipe (121) connecting the flow coming from the basin (125) with the first inlet (131) of the exchanger. This hydraulically controlled valve (141) becomes blocked when the controller is in communication with the water supply network (110) pressure.

A third hydraulically controlled valve (142), called flow stopper valve, is placed on the conduit (122) putting the first outlet (133) of the exchanger (130) in communication with the sewer (120). A valve (111), called supply valve, is placed on a conduit (112) mounted in parallel between the second inlet (132) and the first outlet (133) of the exchanger.

This supply valve (111) is preferably manually operated, for example by means of a pushbutton. Alternatively, said valve (111) is hydraulically operated and in such a case it is open when the controller is in communication with the water supply network pressure (110).

In nominal operation, the controller of the first valve (151) is placed in communication with the water supply network pressure via the 4-way valve (140) so that this first valve blocks the bypass conduit (150).

Controllers of other valves (141, 142, 111) are put into communication with the sewer (120) via the 4-way valve (140) so that the second (141) and third (142) valves are open, the supply valve (111) being closed.

Thus, the collected wastewater from the basin (125) passes through the heat exchanger (130) before joining the sewer and warms the clean water flow heading to the tap (115).

By moving the 4-way valve (140), the controller of the second (141) and third (142) valves are fed, which has the effect of closing said valves.

The bypass valve controller (151) is put into communication with the sewer so that the first valve (151) is open. By operating the supply valve (111), cold water at water supply network pressure (110) is sent to the exchanger (130) at its first outlet (133), causing a flow in reverse to that of the normal flow of waste water in said exchanger. Thus, the fresh water flow under pressure passes through the heat exchanger (130) from its first outlet (133) to its first inlet (131) and then flows to the sewer (120) through the bypass conduit (150).

This back flow under the pressure of the water supply network allows popping the plug obstructing the exchanger inlet and sending said plug to the sewer. Thus, the fresh water flow (240) passing through the exchanger (130) in reverse to the nominal flow is a true purge flow.

Figure 2:
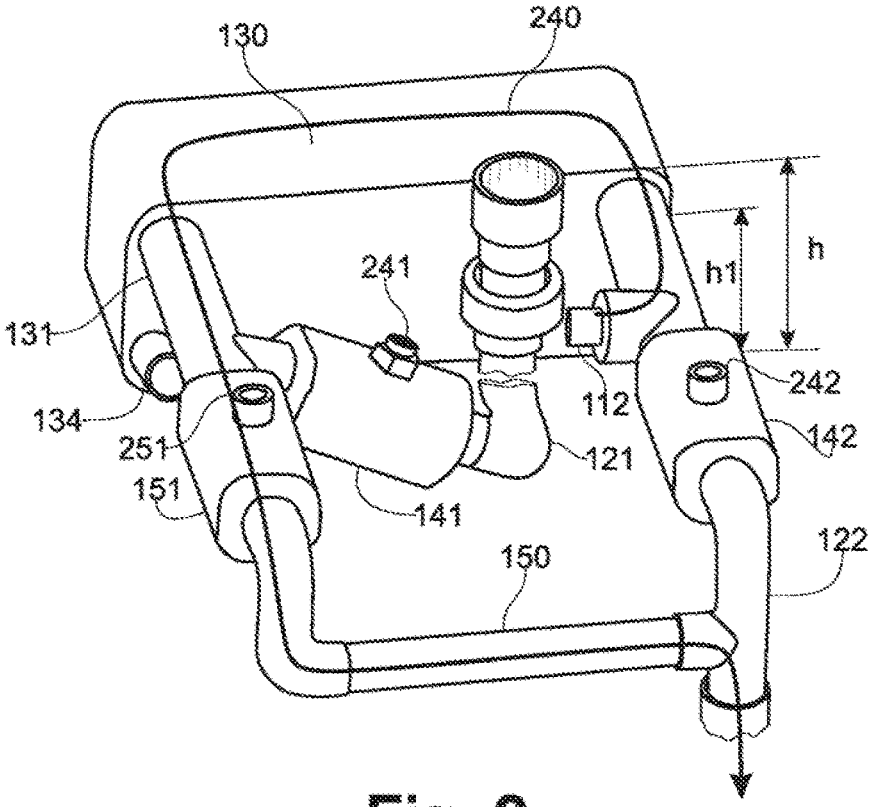
FIG. 2 shows a perspective view of an embodiment of a heat exchanger having hydraulic connections equipped with pinch valves on its first inlet and first outlet.

FIG. 2, according to an embodiment of the device according to the invention, the exchanger (130) is placed with its inlets (131, 132) and outlets (132, 134) horizontally oriented which increases the exchange area of the heat exchanger without increasing too much its height (h) dimension, in order to place it, for example, in the joisting of a floor.

According to this embodiment, the first inlet (131) and the first outlet (133) are placed in the upper part of the exchanger (130), it then acts as a siphon in the plumbing and the siphon of the basing connected to said exchanger are eventually removed to limit pressure drop in gravity flow of waste water. According to this embodiment, an unfilled portion of the heat exchanger is always at the top thereof, at a height corresponding to the height of the inlet lines (131) and outlet (133) of waste water, so a portion of the potential heat exchange area of the heat exchanger is not used, said exchanger being filled up to a height substantially equal to h1 (h−d) where d is the diameter of the pipe carrying wastewater. However, this diameter must be sufficient to meet the standards depending on the nature of the basin feeding the exchanger. Usually d=40 mm.

In order to maintain a sufficient flow section, the controlled valves (141, 142, 151) installed on the pipe receiving wastewater are pinch type valves having a controller (241, 242, 251) able to introduce hydraulic pressure between the sleeve and the body of said valve.

Figure 3:
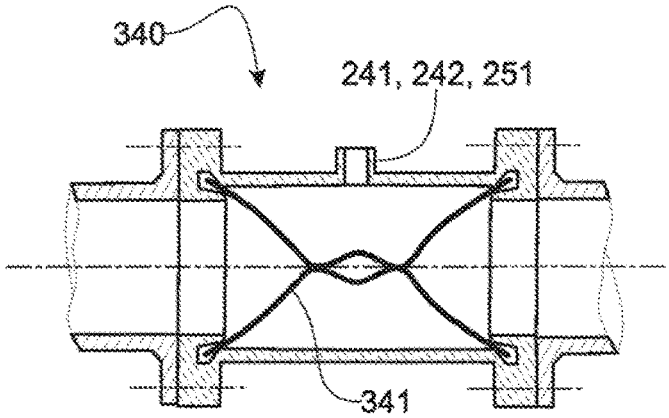
FIG. 3 is a section view of a pinch valve in non-passing position.

FIG. 3, a pinch valve (340) is shown in the closed position, non-passing. When hydraulic pressure is applied to the controller, the sleeve (341) obstructs the passage in the valve. When the controller is in communication with the sewer, the elasticity of the sleeve (341) expels, through the controller, the fluid between said sleeve (341) and the wall of the valve, reopening the passageway. The valve is then open.

Figure 4:
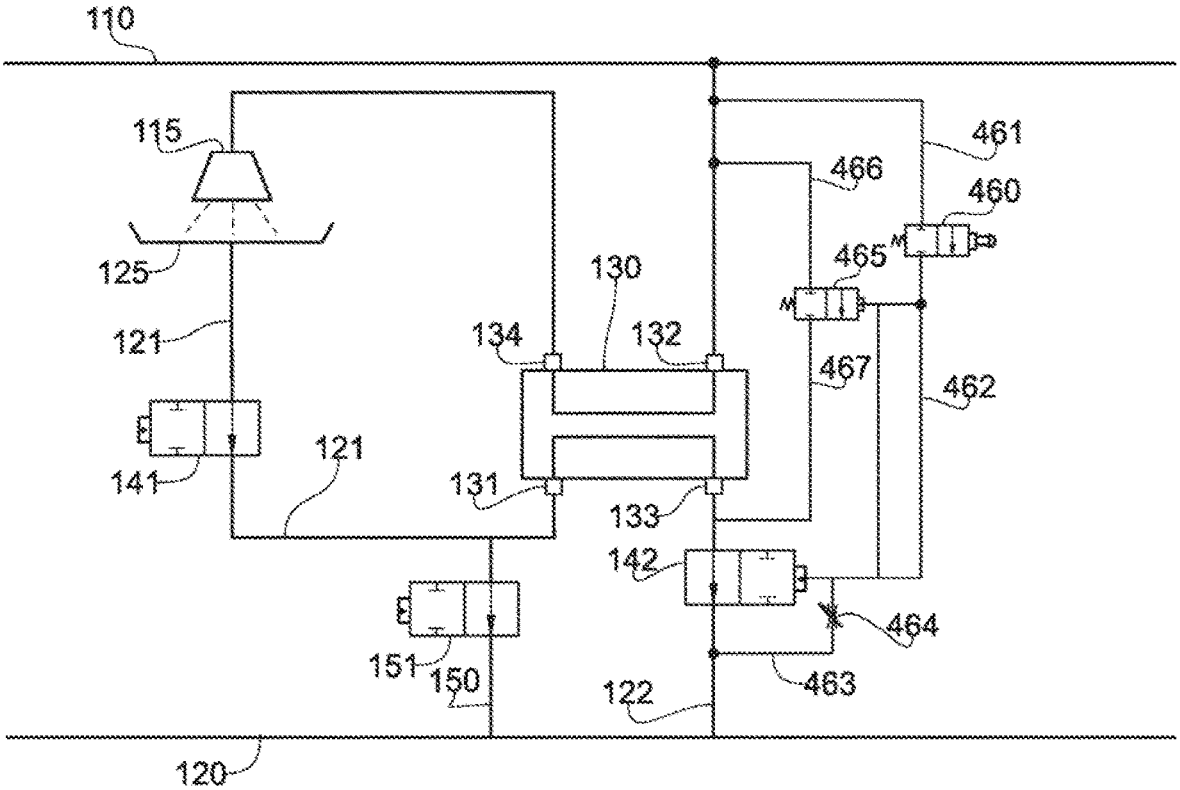
FIG. 4 shows a hydraulic circuit diagram corresponding to another embodiment of the device according to the invention.

FIG. 4, according to another embodiment of the device according to the invention, a bypass conduit (461) on the water supply network connects said network to the inlet of a pinch valve (142), called flow stopper valve, able to close off the first outlet (133) of the exchanger (130). A valve (460), called the purge controller valve, for example a push button, normally closed, is placed on this parallel conduit of the domestic water supply network. Thus, said bypass comprises two conduits, a first conduit (461) communicates the pressure of the domestic water supply network to the purge controller valve (460) and to a second conduit (462), between the purge controller valve (460) and the controller of the flow stopper pinch valve (142).

When the purge controller valve (460) is at rest, that is to say that the pushbutton is not actuated, the second conduit (462) of the bypass is not energized, and the flow stopper pinch valve (142) leaves wastewater flowing to the sewer. The second conduit (462) of this bypass from the water supply network, including the purge controller valve (460), comprises a conduit (463) to bypass the controller of the flow stopper pinch valve (142). This branch (463) includes a narrowing (464) able to create a significant pressure drop in the said conduit (463). By way of non-limiting example, this narrowing (464) is formed by a disc with a small diameter hole, for example a diameter between 1 mm and 1.5 mm. Alternatively the pressure drop is produced by an adjustable throttle valve by means known from the prior art.

A second derivation branch (466) connected to the water supply network, puts in fluid communication said network to the first outlet (133) of the exchanger upstream of the flow stopper pinch valve (142). This second derivation branch includes two bypass conduits (466, 467), as the hydraulic communication between these conduits passes through a hydraulically controlled monostable valve (465), normally closed (not passing). The controller of said valve is in fluid communication with the second conduit (462) of the first branch. Thus, when the purge controller valve (460) is open, and when the pinch valve is closed, the pressure rises in the second conduit (462) of the first branch, until said pressure is sufficient to actuate the controller of the hydraulically controlled monostable valve (465), which then becomes open, putting the first outlet (133) of the exchanger (130) in communication with the water supply network, thus creating a reverse flow in said heat exchanger, from the first outlet (133) to the first inlet (131). This reverse flow can unclog the exchanger (130). To this end the device according to the invention is adjusted, firstly by the pressure drop created by the narrowing means (464) and secondly by the calibration of the controller of the hydraulically controlled monostable valve (465). Thus, the means (464) able to create the pressure drop are adjusted so that the pressure reached in the second conduit (462) when the purge controller valve (460) is actuated, is sufficient to make the hydraulically controlled monostable valve open (465) once the flow stopper pinch valve (142) is closed, but never completely close off the bypass conduit (463).

Thus, when the pushbutton of the purge controller valve (460) is released, the pressure in the second bypass conduit (462) gradually decreases because of the flow limited by the narrowing means (464). Thus, the flow stopper pinch valve (142) opens again and the hydraulically controlled monostable valve (465) resumes its non-passing position, the whole apparatus resuming its nominal operation. The order in which this return to nominal operating conditions is made and the time required for it to complete, are set by the characteristics of the pressure drop means (464) and settings of the controller of the monostable valve (465).

As a non-limiting example, the controller of the monostable valve (465) is calibrated to 2 bar ($2\times10^5$ Pa) and the pressure drop means (464) consists of a disc with a diameter of 1 mm hole in its center, put in the bypass conduit (463).

Figure 5:
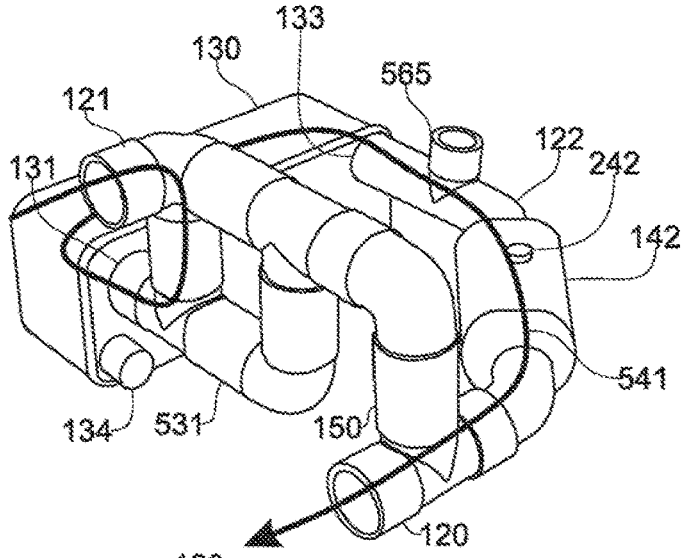
FIG. 5 shows a perspective view of embodiment of the device according to the invention and the flows that occur depending on the situation, FIG. 5A, in the case of nominal operation, FIG. 5B case of clogging of the heat exchanger and 5C in the case of using a purge flow.
Figure 5:
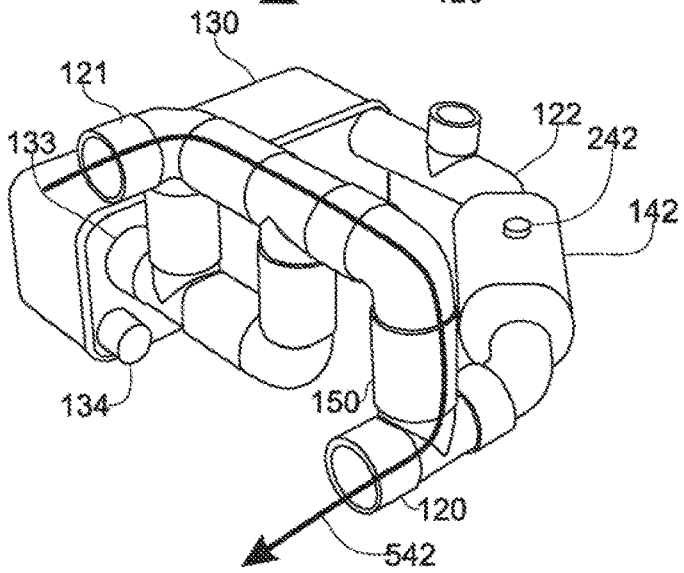
Figure 5:
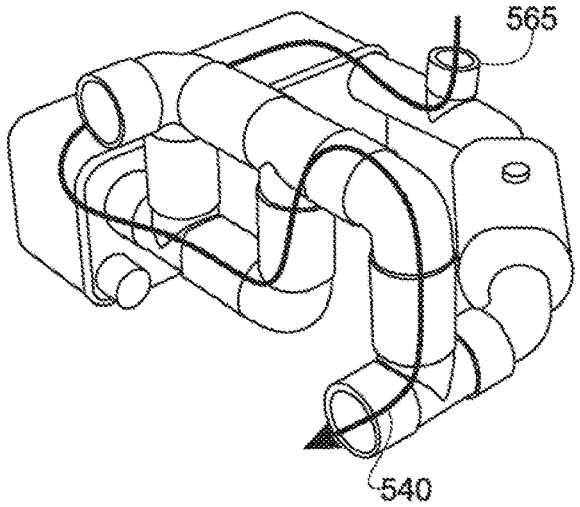

FIG. 5, according to another embodiment of the device object of the invention, the bypass means do not include a valve. According to this embodiment, the bypass conduit (150) and the conduit collecting water from the shower or bath drains (121) are connected in series and are connected in parallel to an inlet conduit (531), which is itself linked to the first inlet (131) of the exchanger (130). As wastewater flows by gravity, it always takes the most direct way, i.e. creating the least pressure drop.

FIG. 5A, in nominal operation, the flow (541) of waste water passes through the exchanger, arriving via the conduit collecting water from the shower plug (121), then flowing through the inlet conduit (531). Said flow (541) then passes through the heat exchanger to the first exit (133) and then to the sewer (120).

FIG. 5B, in case of clogging of the heat exchanger (130), entry to the exchanger (130) is not the most direct path for the flow (542) of waste water from the basin, because of the existence of a pressure drop due to clogging. Thus, said wastewater flow (542) passes through the bypass conduit (150) to the sewer without going through the exchanger (130).

FIG. 5C in order to unclog the exchanger (130), a flow (540) under pressure is injected at the first outlet (133) of the exchanger via a bypassing conduit (565) in parallel with the conduit (122) connecting said first outlet (133) to the sewer (120). This parallel connection is performed upstream of the flow stopper valve (142) considering nominal flow direction. Said purge flow (540) is injected while said flow stopper pinch valve (142) is closed.

Thus, the stream (540) for cleaning enters the exchanger (130) by its first (133) outlet and undergoes a pressure drop when passing through the exchanger, so that on leaving the exchanger through its first inlet (131), pressure of said stream (540) is not sufficient to go up the conduit (121) connected to the basin, up to said basin. Thus, the stream (540) takes the most direct path and passes via the bypass conduit (150) and discharge into the sewer.

Figure 6:
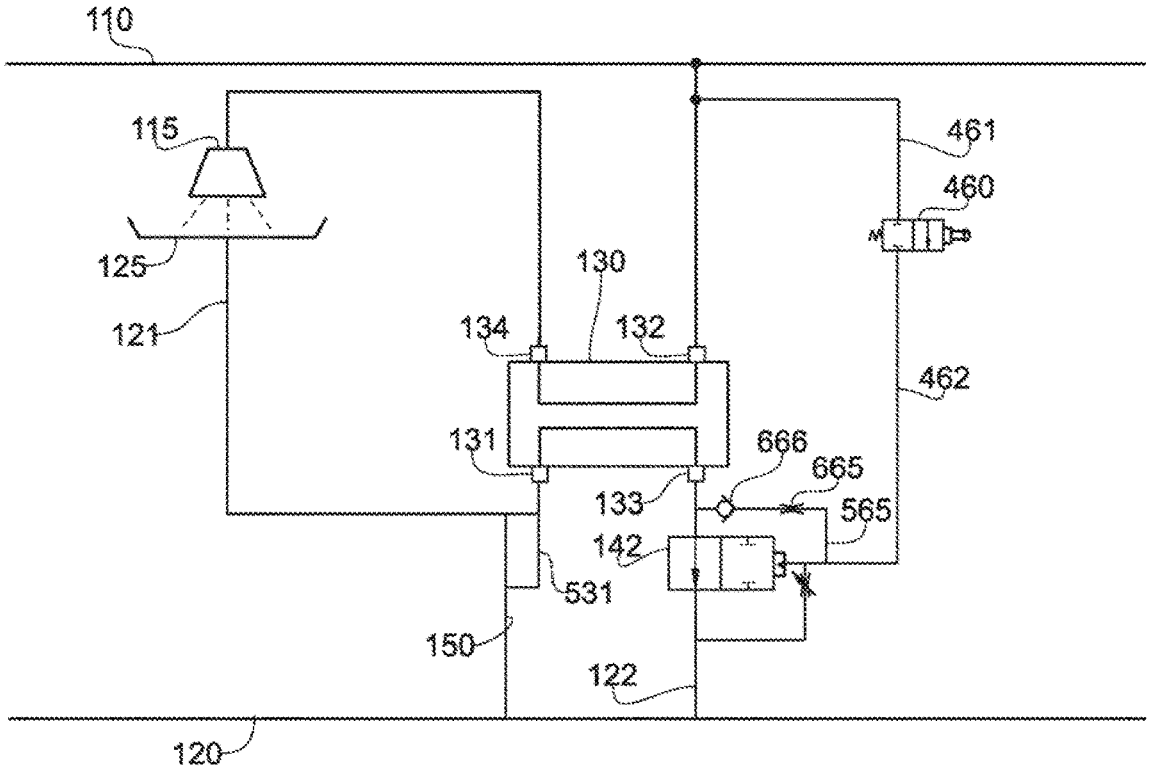
FIG. 6 is a hydraulic diagram of another embodiment of the device according to the invention using the configuration of FIG. 5.

FIG. 6, in another simplified embodiment of the purge, the device of the invention does not comprise a monostable valve. The conduit (462) in communication with the water supply network (110) through the purge controller valve (460), is on the one hand connected to the controller of the flow stopper valve (142) placed on the first (133) outlet of the exchanger (130) and on the other hand in fluid communication with said outlet (133) of the exchanger, through a conduit (565) in parallel, which is connected to the conduit, upstream of the flow stopped pinch valve (142) in the direction of the nominal flow. This bypass conduit (565) comprises means (665) for performing a pressure drop of between 1 and 1.5 bar, according to an exemplary embodiment, for instance using a pipe (665) of reduced diameter for this conduit (565). Said conduit (565) comprises a check valve (666) avoiding pollution of the water supply network with the contents of the exchanger (130). The purge controller valve (460), according to an alternative embodiment, is electrically controlled in order to achieve automation of the purging operation.

Figure 7:
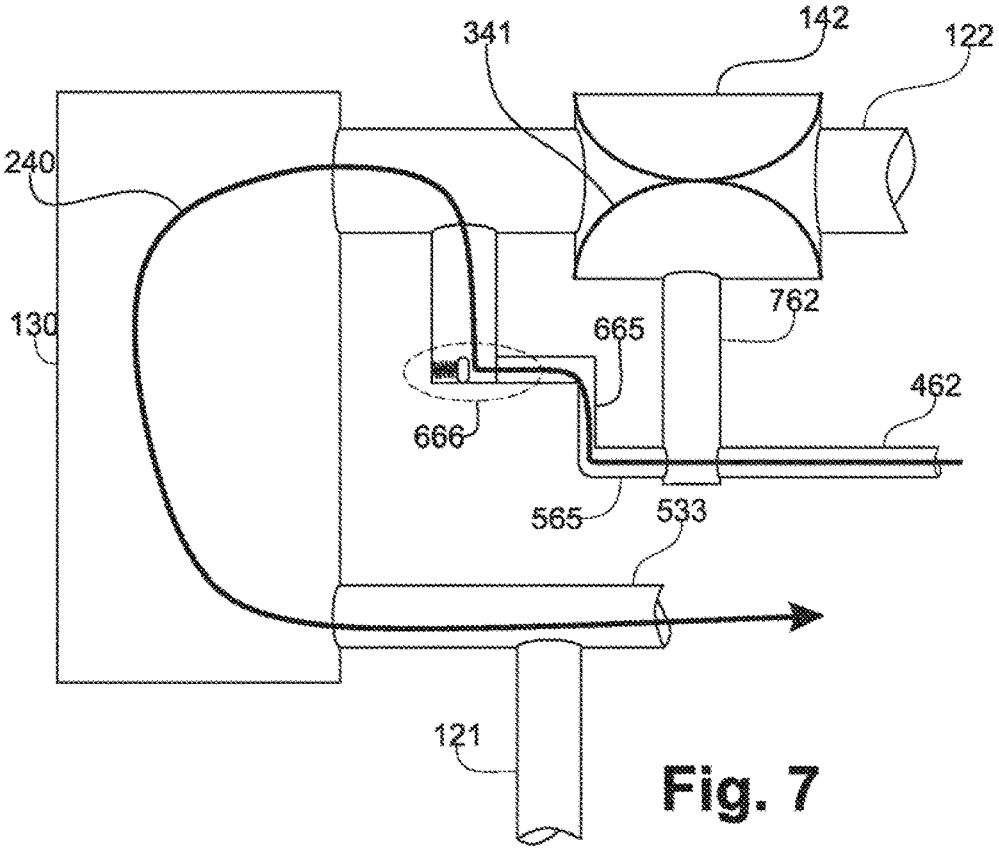
FIG. 7 shows a diagrammatic top view in cross-section, an exemplary embodiment of a purge using the device of FIG. 6.

FIG. 7, when the purge control is actuated, the fresh cold water arrives at the controller of the flow stopper pinch valve (142) through a bypass conduit (762), at the same time it passes through the conduit (565) connecting it to the first inlet (133) of the exchanger (130). Thus, the shutting pressure applied to the sleeve (341) of the flow stopper pinch valve (142) is equal to the pressure generated by the pressure drop means (665) in the conduit (565) supplying the heat exchanger by its first outlet (133), so that the more the heat exchanger is clogged, the more shutting pressure on the controller of the flow stopping pinch valve (142). Calibrating said pressure drop, an adequate balance is found between the purge flow rate and the pinch valve shutting rate for all possible conditions of use. Thus, according to an embodiment using a purge rate of 27.2 liters/min ($4.53\times10^{-4}$ $m^3\cdot s^{-1}$), the pressure applied to the sleeve (341) of the pinch valve (142) is 2.62 bar ($2.62\times10^5$ Pa) and leads to a 99.1% shutting rate of the flow stopper pinch valve (142). According to another exemplary embodiment using a purge flow of 23.9 liters/min ($3.98\times10^{-4}$ $m^3\cdot s^{-1}$), the pressure on the sleeve is 1.98 bar ($1.98\times10^5$ Pa) and the shutting rate of the pinch valve is 96.7%.

According to a third embodiment, the purge rate is 19.3 liters/min ($3.22\times10^{-4}$ $m^3\cdot s^{-1}$), the control pressure of the sleeve valve (142) is 1.28 bar ($1.28\times10^5$ Pa) and the shutting rate of the pinch valve is 83.6%.

The pressure drop (665) is controlled, for example, through the variation of cross-section and length of the conduit (565) connected to the first inlet (133) of the exchanger (130).

Figure 8:
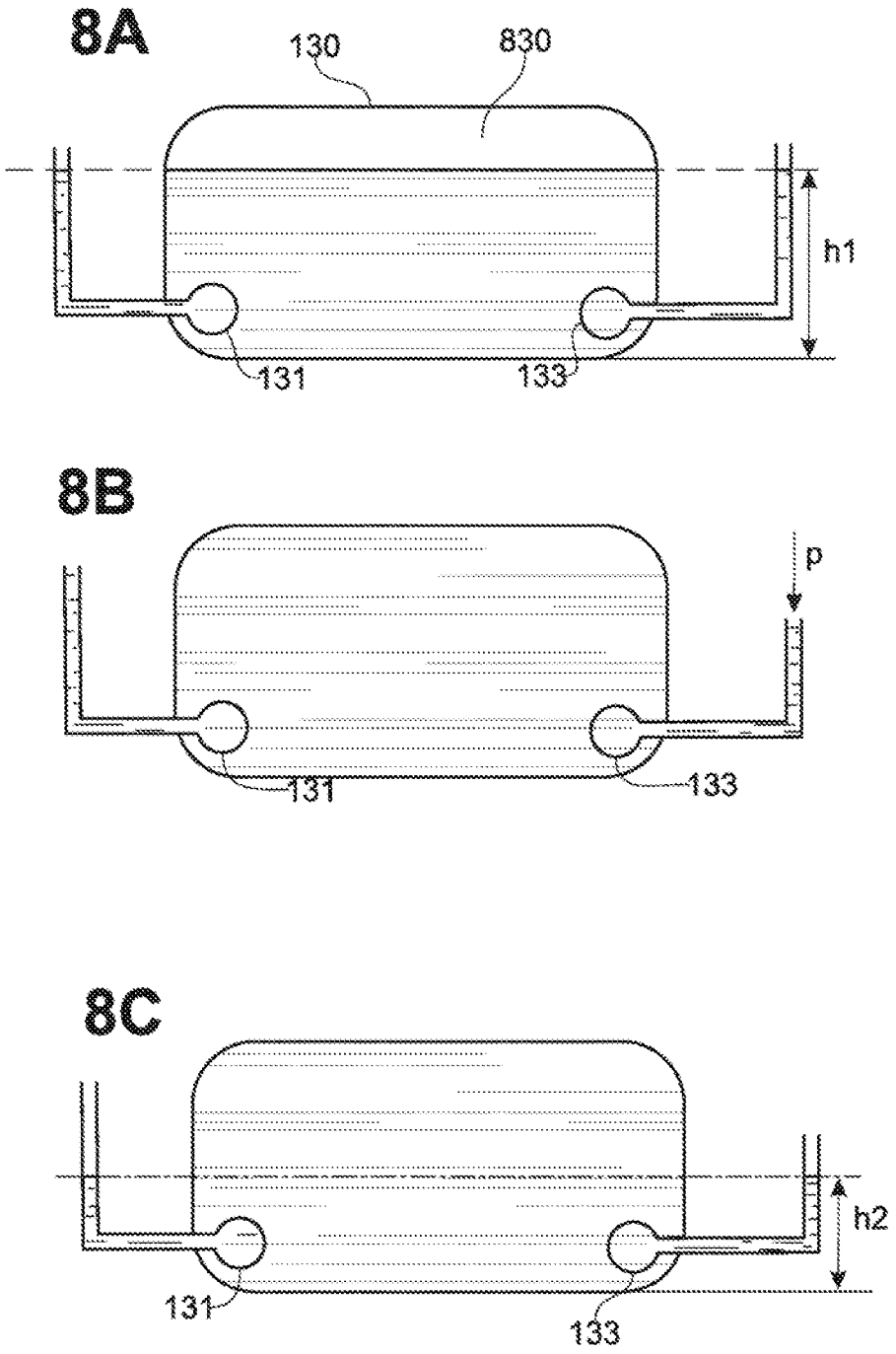
FIG. 8 shows schematically the implementation stages of the water filling method according to the invention, 8A, in situations of normal operation without implementation of the method of the invention, 8B during filling of the exchanger according to the method of the invention and FIG. 8C in normal operation after the implementation of the water filling method according to the invention.

FIG. 8, according to an embodiment of the method according of the invention, the heat exchanger (130) acts as a siphon in the plumbing and siphon drains of the basin connected to said exchanger are removed to limit pressure drop in the flow of waste water. According to this embodiment, an unfilled portion of the heat exchanger is always on top of it, at a height corresponding to the height of the wastewater inlet (131) and outlet (133), so that a portion of the potential heat exchange area is not used, the exchanger being filled only up to a height h1. In order to use the unfilled volume in the exchanger, according to an exemplary embodiment, the first inlet (131) and the first outlet (133) of the exchanger are advantageously placed in the lower part of the exchanger (130).

FIG. 8A, in the absence of implementation of the filling method according to the invention, the heat exchanger and the discharge conduit act as a siphon, and a portion (830) of the exchanger (131) is never filled.

FIG. 8B, in a first stage of the filling method according to the invention, cold water is supplied to the first outlet (133)

of the heat exchanger by operating the purge controller valve (460). The water pressure (p) chases the bubble (830) and fills the exchanger (130).

FIG. 8C, then by placing the heat exchanger under nominal operating conditions, that is to say, releasing the purge controller valve (460), provided the water seal height h2 remaining in the corresponding pipe is sufficient, air does not enter the exchanger whose interior is now in depression and said exchanger remains fully filled. Thus, the efficiency of the system is very much improved.

The above description and the exemplary of embodiments show that the invention achieves the objectives; in particular it allows making the system less susceptible to clogging, maintaining remotely the exchanger in the system and improving its efficiency by optimizing the filling of the exchanger.

The invention claimed is:

1. A device for recovering thermal energy from a flow of wastewater from a basin, comprising:

a plate heat exchanger traversed by two separate fluid flows:

a first inlet of the heat exchanger, placed in a fluid communication with a wastewater outlet of the basin, to provide a first flow passing through the heat exchanger between the first inlet and a first outlet of the heat exchanger, the first outlet being connected to a sewer;

a second inlet of the heat exchanger, placed in a fluid communication with a clean water conduit of a pressurized water supply network, to provide a second flow passing through the heat exchanger, without mixing with the first flow, between the second inlet and a second outlet of the heat exchanger;

a bypass conduit to provide a hydraulic connection between the first inlet of the heat exchanger and the sewer; and a controlled connector configured to provide a temporary hydraulic connection, wherein the controlled connector connects the clean water conduit of the pressurized water supply network and the first outlet of the heat exchanger to provide a purge flow through the heat exchanger between the clean water conduit and the sewer via the bypass conduit.

2. The device according to claim 1, wherein the controlled connector comprises a flow stopper pinch valve between the first outlet of the heat exchanger and the sewer.

3. The device according to claim 2, further comprising a purge valve configured to place the pressurized water supply network in communication with the first outlet of the heat exchanger, and to place a controller of the flow stopper pinch valve for closing off the flow stopper pinch valve in communication with a shutting pressure.

4. The device according to claim 3, wherein the purge valve comprises:

a hydraulically controlled mono-stable valve closed and opened under a predetermined pressure to place the first inlet of the heat exchanger in communication with the pressurized water supply network upstream and of the sewer; and a conduit utilizing a purge controller valve to place a controller of the hydraulically controlled mono-stable valve in fluid communication with the controller of the flow stopper pinch valve and the pressurized water supply network.

5. The device according to claim 3, wherein the purge valve comprises:

a purge controller valve and a conduit configured to place the controller of the flow stopper pinch valve and the first outlet of the heat exchanger with the pressurized water supply network; and a regulator configured to create a pressure drop in the conduit of the pressure valve in a fluid communication with the first outlet of the heat exchanger.

6. The device according to claim 5, wherein the purge controller valve is a programmable valve.

7. A method for water filling a device for recovering thermal energy from a flow of wastewater from a basin, the device comprises:

a plate heat exchanger traversed by two separate fluid flows:

a first inlet of the heat exchanger, placed in a fluid communication with a wastewater outlet of the basin, to provide a first flow passing through the heat exchanger between the first inlet and a first outlet of the heat exchanger, the first outlet being connected to a sewer;

a second inlet of the heat exchanger, placed in a fluid communication with a clean water conduit of a pressurized water supply network, to provide a second flow passing through the heat exchanger, without mixing with the first flow, between the second inlet and a second outlet of the heat exchanger;

a bypass conduit to provide a hydraulic connection between the first inlet of the heat exchanger and the sewer;

a controlled connector configured to provide a temporary hydraulic connection, wherein the controlled connector connects the clean water conduit of the pressurized water supply network and the first outlet of the heat exchanger to provide a purge flow through the heat exchanger between the clean water conduit and the sewer via the bypass conduit, the controlled connector comprises a flow stopper pinch valve between the first outlet of the heat exchanger and the sewer;

a purge valve configured to place the pressurized water supply network in communication with the first outlet of the heat exchanger, and to place a controller of the flow stopper pinch valve for closing off the flow stopper pinch valve in communication with a shutting pressure;

a progressive return conduit to place the controller of the flow stopper pinch valve in fluid communication and in parallel with the sewer, the progressive return conduit comprises a regulator to create a pressure drop in the progressive return conduit; and the method comprises the steps of filling the heat exchanger with water and expelling air trapped in passages of the heat exchanger where the wastewater flows by actuating the purge valve.

* * * * *